United States Patent [19]

Johnson

[11] Patent Number: 4,784,108

[45] Date of Patent: Nov. 15, 1988

[54] GRINDING WHEEL DRESSING APPARATUS

[76] Inventor: Lloyd E. Johnson, 3583 Sunset Knolls Dr., Thousand Oaks, Calif. 91360

[21] Appl. No.: 104,293

[22] Filed: Oct. 5, 1987

[51] Int. Cl.[4] ..... B24B 53/00

[52] U.S. Cl. ..... 125/11 DF; 125/11 NT; 125/11 GA; 125/11 BS; 125/11 B; 51/50

[58] Field of Search ..... 51/5 D; 125/11 AS, 11 R, 125/11 DF, 11 BS, 11 NT, 11 GA, 11 B

[56] References Cited

U.S. PATENT DOCUMENTS

| | | | |
|---|---|---|---|
| 2,366,623 | 1/1945 | Jakobsen | 125/11 AS |
| 2,377,822 | 6/1945 | Storm | 125/11 R |
| 4,011,689 | 3/1977 | Cozzini | 125/11 BS |

FOREIGN PATENT DOCUMENTS

| | | | |
|---|---|---|---|
| 2019260 | 11/1971 | Fed. Rep. of Germany | 125/11 DF |
| 0076793 | 1/1977 | Japan | 125/11 DF |

*Primary Examiner*—Frederick R. Schmidt
*Assistant Examiner*—Blynn Shideler
*Attorney, Agent, or Firm*—Jack C. Munro

[57] ABSTRACT

An apparatus for dressing a grinding wheel which utilizes a pair of cutting tools which are mounted in an in-line facing relationship with the grinding wheel to be located between the tools. These tools are to be moved to simultaneously engage the side walls of the grinding wheel so that, as the grinding wheel is rotated, both sides of the grinding wheel are dressed at the same time. The apparatus also includes a pair of second cutting tools which are to be used for forming bevels on the circumferential edge of the grinding wheel.

1 Claim, 3 Drawing Sheets

GRINDING WHEEL DRESSING APPARATUS

BACKGROUND OF THE INVENTION

The field of this invention relates to machine tools and more particularly to an apparatus which is to be mounted in conjunction with a grinding wheel machine tool for the purpose of accurately dressing the grinding wheel.

A machine tool is a power driven machine for shaping metal generally through the use of a series of repeated cutting operations. One form of a machine tool is a grinding machine. A particular type of grinding machine uses a disc-shaped grinding wheel. Every grinding wheel has two components with one being the abrasive, which does the actual cutting, and the bond which is utilized to hold the abrasive together. Typical abrasives would be aluminum oxide, silicon carbide and diamonds. The abrasive is formed into grains with each grinding wheel being constructed of a particular size of grains.

In the shaping of metal, it is common to form lineal grooves within metal plates or annular grooves within cylindrically shaped metallic objects. A common way in which these grooves can be formed is through the utilizing of a grinding wheel. These grinding wheels can be shaped to a precise size and a precise configuration to result in the precise forming of a groove. It is exceedingly common for these grooves to be formed accurately with grinding wheels within a few thousandths of an inch.

The user will purchase the grinding wheel in an oversized condition. The grinding wheel will then have to be "dressed". Dressing a grinding wheel generally includes narrowing of the width of the thickness of the grinding wheel to assume a precise thickness and also possibly accurately forming an inclined bevel within the circumference of the wheel.

In the past, dressing of wheels has been completed directly on the grinding machine. A cutting tool is utilized, usually in the form of a diamond headed cutter which is pressed against the side wall of the grinding wheel, as the wheel is rotated and is moved from the circumference inward a desired amount toward the hub of the grinding wheel. If the resultant groove to be formed is a half of an inch in depth, then it is only necessary to dress the wheel to a depth of a little over half of an inch from the circumference of the wheel.

It is to be kept in mind that accuracy in forming of the wheel is exceedingly important since the wheel is frequently used to reproduce a highly accurate groove within a metallic workpiece. If a single cutter is utilized to dress the wheel, and that cutter is pressed against one side wall of the wheel, inherently the wheel will deflect slightly in a direction away from the cutter. Therefore, as a result, when the cutter is removed from the wheel, the wheel will then deflect back resulting in the side wall of the wheel being ever so slightly inclined relative toits plane of rotation. Now the operator proceeds to dress the opposite side of the wheel and the same problem occurs. Therefore, when the wheel is utilized, the wheel is not formed to the greatest degree of accuracy that may be required in order to reproduce within certain tolerances a groove within the metallic workpiece.

SUMMARY OF THE INVENTION

The primary objective of the present invention is to utilize an apparatus for the dressing of a grinding wheel wherein both of the side walls of the wheel are dressed simultaneously thereby eliminating any deflection of the wheel due to the dressing operating which will produce a grinding wheel of less than desired accuracy.

The grinding wheel dressing apparatus of the present invention utilizes a base which is adapted to be fixedly mounted on the workpiece supporting table of a grinding machine. Mounted on this base is a platform with this platform being pivotally movable relative to the base and fixed at precisely set angular relationship relative to the base. Mounted on the platform is a plate with this plate being lineally movable relative to the platform. Mounted on this plate are a pair of elongated arms with these arms being located in a parallel spaced apart relationship. These arms are movable relative to the plate so they can be moved either toward each other or away from each other at the same rate of movement. Mounted on the outer end of the arms is a first pair of cutters with therebeing a separate cutter mounted on each arm and the cutters being located in an in-line facing relationship in respect to each other. Each cutter is to contact a side wall of the grinding wheel. The cutters are to be positioned to contact the side walls of the grinding wheel at the same time and at the same depth and, as these cutters are moved toward the hub of the grinding wheel, each side of the grinding wheel will thereby be dressed. Mounted on the plate and extending in a direction exteriorly of the apparatus is a second pair of cutters. This second pair of cutters is to be used to form an inclined annular surface on the circumference of the grinding wheel.

DETAILED DESCRIPTION OF THE SHOWN EMBODIMENT

Figure 1:
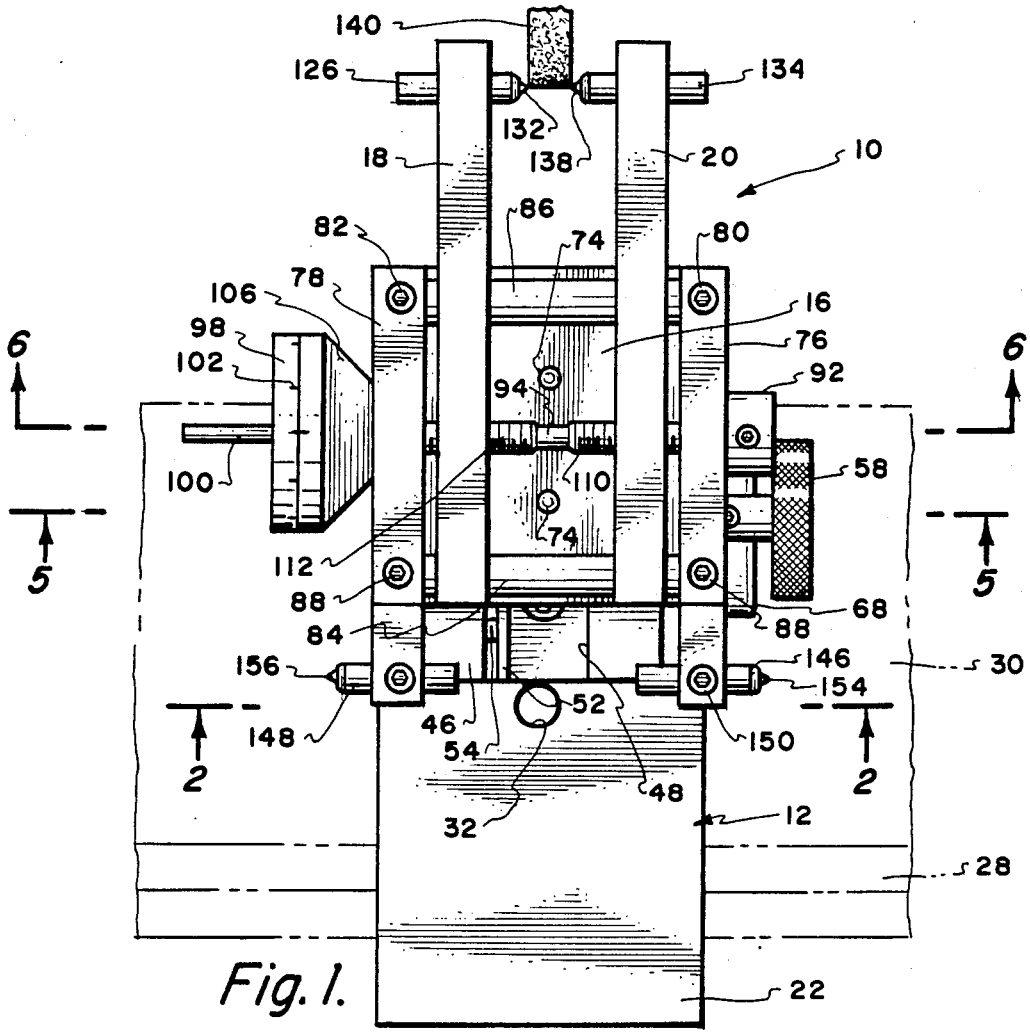
FIG. 1 is a top plan view of the grinding wheel dressing apparatus of this invention showing the apparatus mounted in conjunction with a grinding wheel to initially begin dressing the side walls of the grinding wheel.
Figure 2:
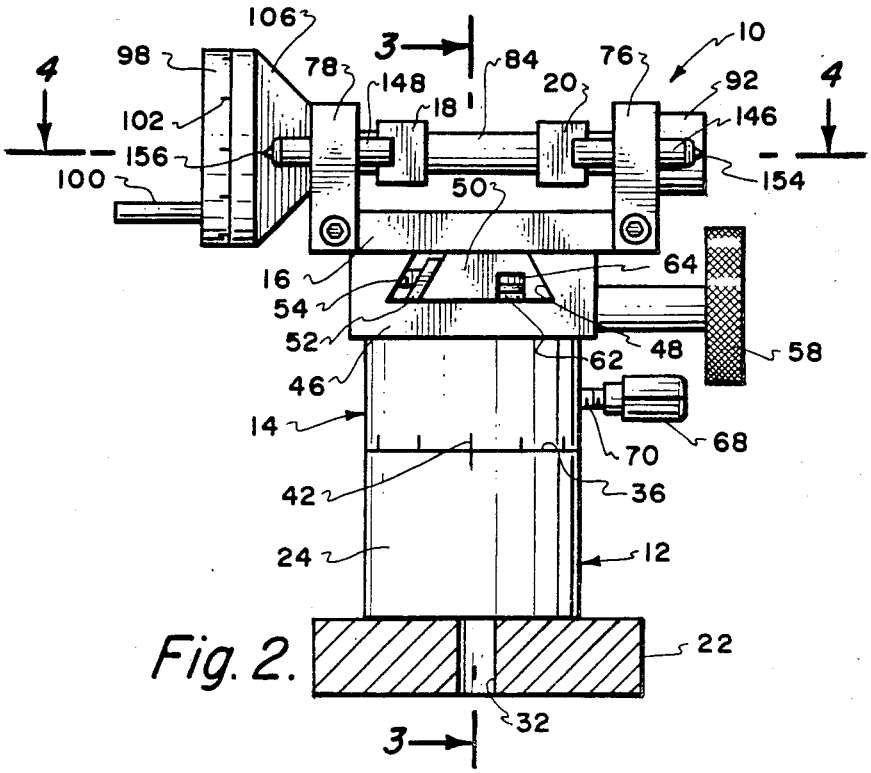
FIG. 2 is a cross-sectional view taken along line 2—2 of FIG. 1.
Figure 3:
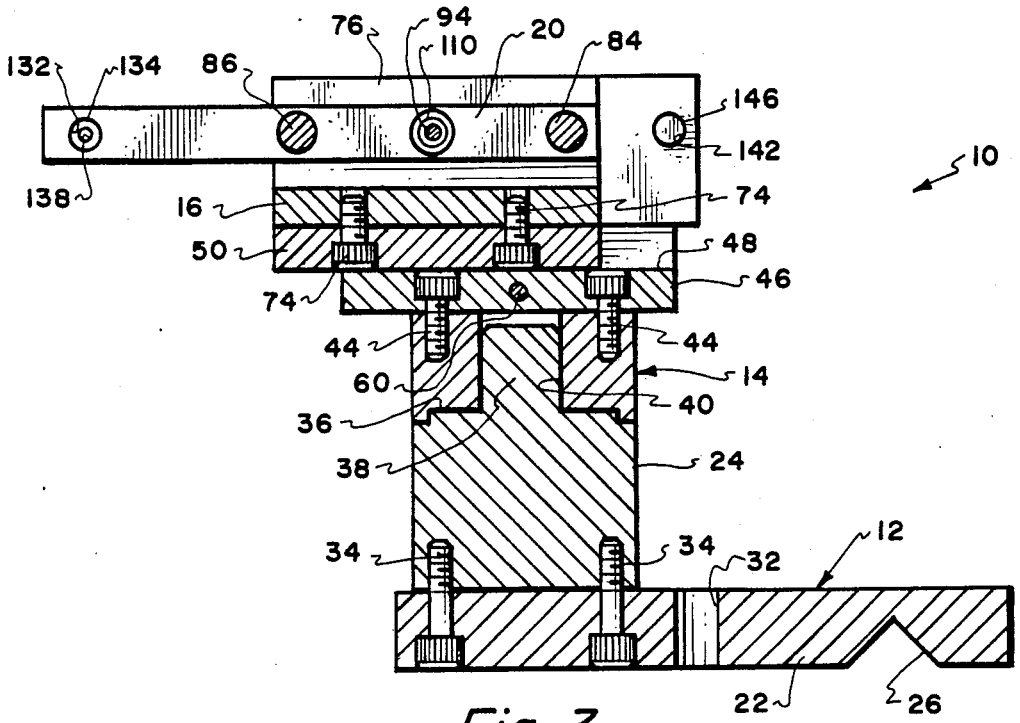
FIG. 3 is a cross-sectional view taken along line 3—3 of FIG. 2.
Figure 4:
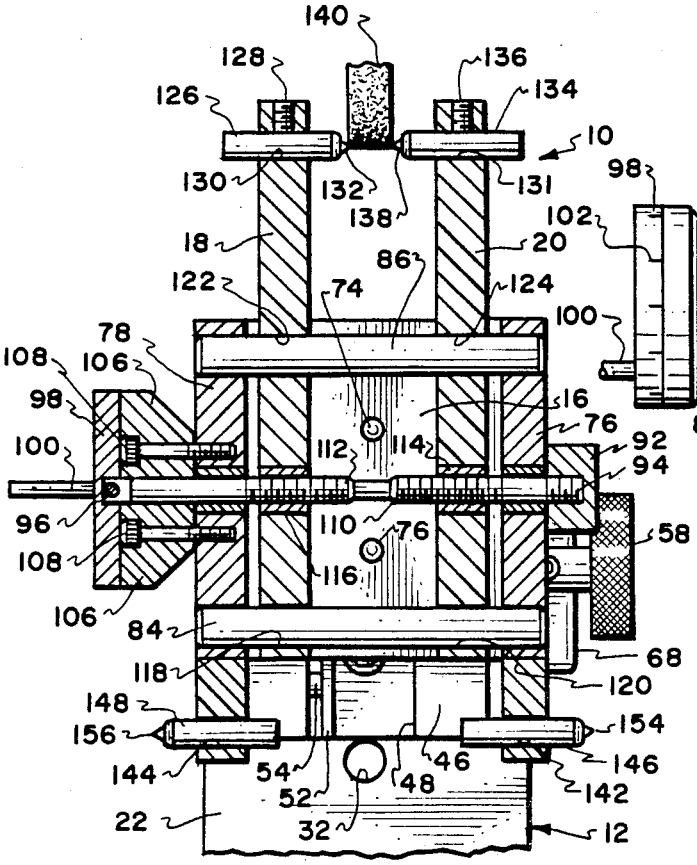
FIG. 4 is a top plan cross-sectional view taken along line 4—4 of FIG. 2 showing in more detail the structure associated with the apparatus of the present invention.
Figure 5:
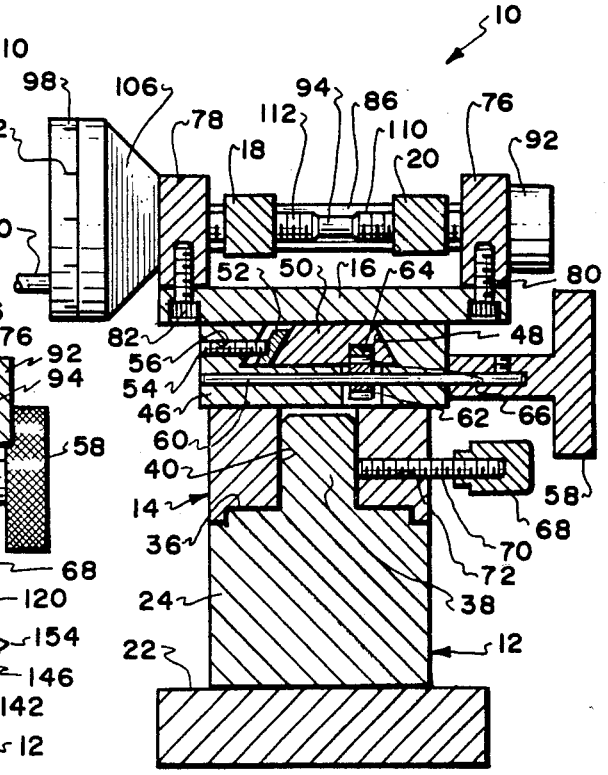
FIG. 5 is a front cross-sectional view of the apparatus of this invention taken along line 5—5 of FIG. 1.
Figure 6:
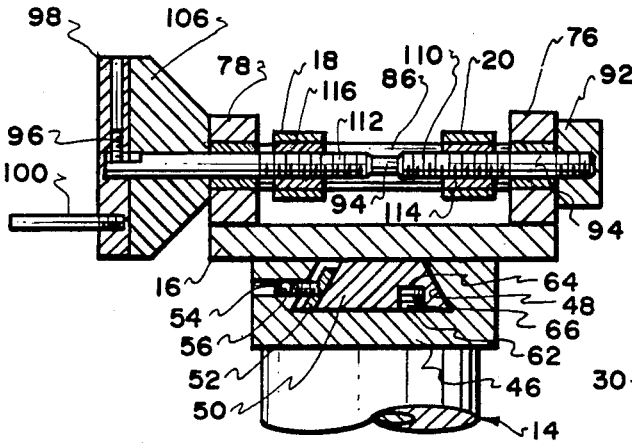
FIG. 6 is a front cross-sectional view taken along line 6—6 of FIG. 1 showing in more detail the mechanism utilized to move the arms upon which the cutters of the apparatus of the present invention are mounted.
Figure 7:
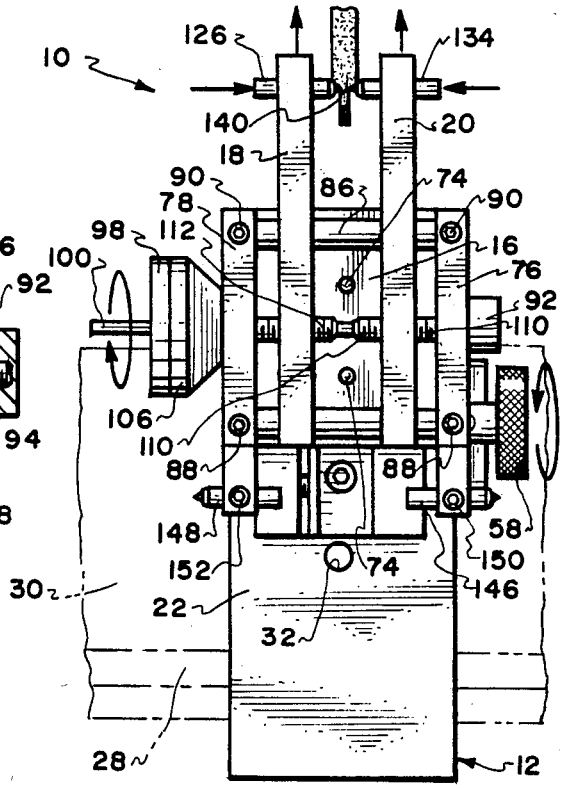
FIG. 7 is a view similar to FIG. 1 but showing the cutters in a position in which dressing of the grinding wheel has occurred with the dressing of the wheel being depicted in an exaggerated manner for illustrative purposes.
Figure 8:
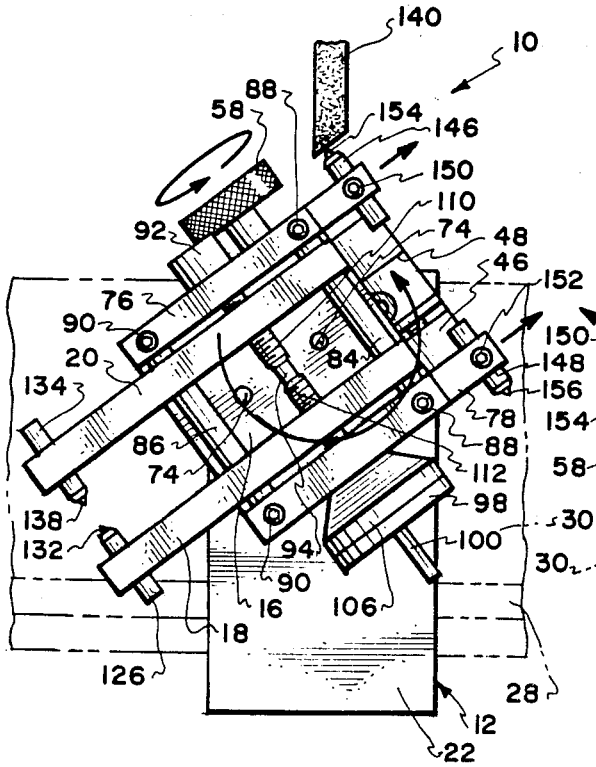
FIG. 8 is a top plan view of the apparatus of this invention showing the apparatus in a position to affect producing of a right hand bevel on the grinding wheel.
Figure 9:
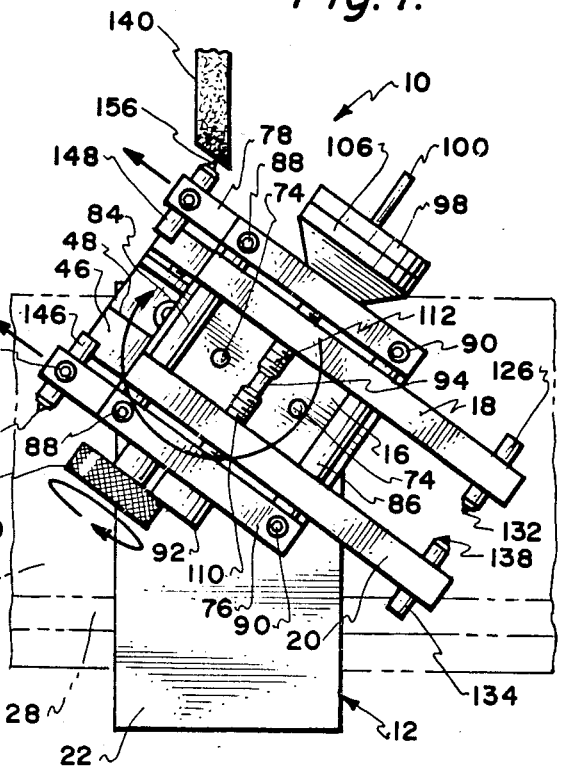
FIG. 9 is a view similar to FIG. 8 but showing the apparatus in the position to produce a left hand bevel on the grinding wheel.

Referring particular to the drawings there is shown the grinding wheel dressing apparatus 10 of this invention which includes, generally, a mounting base 12, a platform 14, a plate 16 and arms 18 and 20. Base 12 includes a bottom member 22 and an upright post section 24. Within the bottom surface of the bottom member 22 is formed a triangularly shaped through groove 26. This groove 26 is to matingly connect with a ridge 28 of a workpiece supporting table 30 of a grinding machine (not shown). The use of ridges 28 are exceedingly common in order to facilitate mounting of workpieces and other structures on the table 30. By the locating of the groove 26 in connection with the ridge 28, a desired initial positioning of the apparatus 10 is achieved on the table 30. Also, formed through the bottom member 22 is a hole 32. The function of the hole 32 is to permit the passing therethrough of a fastener (not shown) such as a bolt which is to engage with an appropriate threaded opening of the table 30 in order to fixedly secure in position the apparatus 10 to the table 30.

The upright post 24 is fixedly mounted to the bottom member 22 by means of bolt fasteners 34. The upper end of the post 34 terminates in an annular ledge 36 surrounding a centrally located narrow post section 38. The bottom of the platform 14 rests against the ledge 36 with there also being formed a centrally disposed opening 40 within the platform 14 with the narrow post section 38 being located within the opening 40 in a close fitting manner. However, the platform 14 is capable of being pivoted relative to the post 24. The amount of pivoting in degrees can be ascertained by numerical and lined indicia 42 inscribed on the exterior surface of the platform 14 and upstanding post 24 directly adjacent ledge 36. When a particular desired angular position is obtained between the platform 14 and the upstanding post 24, the platform 14 can be fixed relative to the post 24 by means of turning of handle 68 which is mounted on threaded member 70. Threaded member 70 is mounted within the threaded opening 72 formed within platform 14. The inner end of the threaded member 70 is to contact narrow post section 38 to thereby secure the platform 14 to the upstanding post 24.

Fixedly secured to the platform 14 by means of bolt fasteners 44 is an upper platform section 46. Formed within the upper platform section 46 is a female portion of a dovetail slot 48. Slideably mounted for lineal movement within the dovetail slot 48 is the male dovetail member 50. Also located within the slot 48 directly abutting member 50 is a pressure strip 52. Connecting with pressure strip 52 are a plurality of set screws 54. The set screws 54 are mounted within threaded openings 56 formed within upper platform section 46. The function of the set screws 54 is that they can be tightened which creates pressure against pressure strip 52 which in turn presses against male dovetail slot member 50. Adequate pressure is to be applied so that there is a snug connection obtained between the member 50 and the member 46 but yet member 50 can be moved relative to member 46. Lineal movement of member 50 relative to member 46 is accomplished by turning of handle 58 which turns rod 60. Fixedly mounted on rod 60 is a gear 62. Gear 62 connects with gear strip section 64 which is mounted within groove 66 of the male dovetail slot member 50. It can thus be seen by turning of handle 58, the gear 62 rotates which in turn operates against the strip section 64 to move dovetail slot member 50 relative to upper platform section 46.

The male dovetail slot section 50 is fixedly secured by bolt 74 to plate 16. Mounted on the upper surface of the plate 16 and located at one lateral edge thereof and forming a part of plate 16 is an outer bar 76. The bar 76 is attached to the plate 16 by means of threaded fasteners 80. In a similar manner an inner bar 78 is secured by threaded fasteners 82 to the plate 16 directly adjacent the opposite lateral edge thereof and again forms in essence a part of the plate 16. Connecting between bars 76 and 78 are a pair of spaced apart pins 84 and 86. Pin 84 is fixedly held in position between bars 76 and 78 by bolt fasteners 88. Pin 86 is similarly fixed and held in position between the bars 76 and 78 by means of bolt fasteners 90.

Mounted against the outside surface of the bar 76 is a nut 92. Threadably secured to the nut 92 is the outer end of a rod 94. The inner end of the rod 94 is fixedly secured by a set screw 96 to an enlarged handle 98. To facilitate rapid turning of the handle 98 there is attached thereto and extending outwardly therefrom a handle rod 100. Formed on the exterior surface of the handle 98 is a series of inscribed numerical and lined indicia 102. The indicia 102 is to be readable in conjunction with an indicia formed on the exterior surface of enlarged member 106. Member 106 is fixedly mounted by bolt fasteners 108 to bar 78.

Formed on the rod 94 in between bars 76 and 78 is a left-handed threaded section 110 and a right-handed threaded section 112. Threaded section 110 is in continuous engagement with a threaded sleeve 114. In a similar manner the threaded section 112 is in continuous threaded engagement with a threaded sleeve 116. The sleeve 114 is mounted within arm 20 and sleeve 116 is mounted within arm 18.

Pin 84 is conducted through hole 118 of arm 18 and also is conducted through hole 120 of arm 20. In a similar manner, pin 86 is conducted through hole 122 of arm 18 and through hole 124 of arm 20. Arms 18 and 20 are capable of sliding movement on pins 84 and 86. When the apparatus 10 of this invention is assembled, the member 18 is initially located abutting against bar 78 and arm 20 is initially located abutting against bar 76. Therefore, upon handle 98 being rotated arm 20 is moved toward arm 18 and similarly arm 18 is moved toward arm 20. Both movements occur at the same rate since the threads 110 and 112 are identical with the exception of one being left-handed and one being right-handed. The arms 18 and 20 are constantly maintained parallel to each other and slide along pins 84 and 86.

Mounted within the free outer end of arm 18 by means of set screw 128 is a cutter 126. Cutter 126 is located within hole 130 of arm 18. The cutter 126 terminates in a diamond point 132. It is to be understood that the cutter 126 is to be adjustable in respect to the arm 18 by loosening of set screw 128 and then retightening of set screw 128 once the desired selected position of the cutter 126 has been established relative to the arm 18.

Mounted in a similar manner within hole 131 formed within the outer end of arm 20 is a cutter 134. The cutter 134 is fixed in position on the arm 20 by means of set screw 136. The cutter 134 terminates at its outer end in a diamond 138.

It is to be noted that the cutters 126 and 134 are located in an aligned manner with the diamonds 132 and 138 facing each other and located between the arms 18 and 20. Diamond 132 is to contact one side of the grinding wheel 140 with diamond 138 to contact the opposite side of grinding wheel 140.

The portion of bar 76 that is located furthest from cutter 134 has a hole 142. Similarly a hole 144 is formed within the end of bar 78. Within hole 142 is to be located a cutter 146 with a cutter 148 being located within hole 144. Cutter 146 is fixedly held in position respective to bar 76 by means of set screw 150. A similar set screw 152 securely mounts the cutter 148 onto bar 78. Cutter 146 terminates in a diamond 154 with cutter 148 terminating in diamond 156. It is to be noted that cutters 146 and 148 are again in alignment with respect to each other but in this particular instance the diamonds 154 and 156 are not facing each other but are facing in opposite directions.

The operation of the apparatus 10 of this invention is as follows: Let it be assumed that the apparatus 10 is mounted on the table 30 as shown within FIG. 1 of the drawings. Handle 68 is turned to loosen threaded member 70 with platform 14 being placed at the zero degree position relative to upstanding post member 24. At that particular time, the handle member 68 is tightened thereby securing in position platform 14 relative to post member 24. The operator either moves table 30 or turns handle 58 (or both) until diamonds 132 and 138 come into contact with their respective side walls of the grinding wheel 140 as shown in FIG. 1 of the drawings. It is to be noted that the diamonds 132 and 138 will be placed into contact with their respective side walls of the grinding wheel 140 and then the diamonds 132 and 138 are backed off by turning of handle 58 so that they are just slightly spaced from the grinding wheel 140. Let us assume at this time the operator wishes to remove five thousandths of an inch from the thickness of the grinding wheel 140. The operator then turns handle 98 and by observing of indicia 102 can move to the five thousandths of an inch position. At this particular time the operator causes grinding wheel 140 to be rotated. The operator will normally move table 30 in an inward position causing the diamonds 132 and 138 to move against their respective side walls of the grinding wheel 140 to thereby physically remove a portion of the side walls of the grinding wheel 140. In this manner, the grinding wheel 140 can be dressed (decreased in thickness) to a preset desirable amount such as is clearly represented within FIG.ure 7 of the drawings. Once a desired thickness of the grinding wheel 140 has been obtained, the diamonds 132 and 138 are disengaged from the wheel 140 and generally the apparatus 10 will be removed entirely from the table 30.

At times it may be desirable to locate an inclined section or bevel within the circumference of the grinding wheel 140. To form a right-hand bevel, handle 68 is loosened and platform 14 is pivoted to the desired angular position relative to upstanding post 24. Once a desired angular position has been obtained, the handle 68 is then tightened to secure platform 14 to upstanding post 24. The diamond 154 is then placed against the circumference of the grinding wheel 140 and is moved back-and-forth across the outer edge of the grinding wheel 140 as the grinding wheel 140 is rotated. The movement of the cutter 154 is accomplished by manual turning of handle 58 which results in plate 16 being moved lineally relative to platform section 46. Movement of the diamond 154 toward the wheel 140 occurs by small increments of movement of table 30 toward the wheel 140.

In a similar manner, if a left-hand bevel was desired to be produced within the grinding wheel 140, the diamond 156 of the cutter 148 is positioned to contact the circumference of the grinding wheel 140 and again by turning of handle 58 the diamond 156 is caused to progressively cut into the wheel 140. Movement of the diamond 156 toward the wheel 140 occurs by small increments of movement of table 30 toward the wheel 140.

What is claimed is:

1. A grinding wheel dressing apparatus comprising:

a base, said base being adapted to be mounted on the workpiece supporting table of a wheel grinding machine;

a platform mounted on said base, said platform being pivotally movable to and fixable in different positions relative to said base;

a plate mounted on said platform, said plate being lineally movable relative to said platform;

a pair of tool support arms mounted on said plate, said tool support arms being simultaneously movable on said plate, movement of said arms being either toward each other or away from each other, both said arms move at the same rate of movement;

a first cutting tool mounted on each said arm with therebeing a separate said first cutting tool for each said arm, said first cutting tools being located in a spaced apart relationship with a grinding wheel adapted to be located between said first cutting tools, whereby said first cutting tools are to cut into the opposite side walls of the grinding wheel thereby forming the grinding wheel to a desired thickness; and a pair of second cutting tools mounted on said plate, each said second cutting tool protruding exteriorly of said plate so as to facilitate forming of an annular beveled surface on the circumferential edge of the grinding wheel, said second cutting tools being located in an oppositely facing direction relative to each other.

* * * * *